US012631388B2

(12) United States Patent
Gürel et al.

(10) Patent No.: US 12,631,388 B2
(45) Date of Patent: May 19, 2026

(54) COOLING DEVICE HAVING A BACK COVER

(71) Applicant: BSH Hausgeräte GmbH, Munich (DE)

(72) Inventors: Necati Bora Gürel, Augsburg (DE); Veysel Tekce, Tekirdag (TR); Gürcan Durmaz, Tekirdag (TR); Jose Alberto Rodriguez Chavez, Oak Ridge, TN (US)

(73) Assignee: BSH Hausgeräte GmbH, Munich (DE)

( * ) Notice: Subject to any disclaimer, the term of this patent is extended or adjusted under 35 U.S.C. 154(b) by 132 days.

(21) Appl. No.: 18/591,302

(22) Filed: Feb. 29, 2024

(65) Prior Publication Data

US 2024/0302093 A1 Sep. 12, 2024

(30) Foreign Application Priority Data

Mar. 6, 2023 (TR) ..... 2023/002470
Mar. 6, 2023 (TR) ..... 2023/002472

(51) Int. Cl.
*F25D 17/06* (2006.01)
*F25D 11/02* (2006.01)
*F25D 23/06* (2006.01)

(52) U.S. Cl.
CPC ..... *F25D 17/062* (2013.01); *F25D 23/065* (2013.01); *F25D 11/02* (2013.01); *F25D 17/065* (2013.01); *F25D 2201/10* (2013.01); *F25D 2317/063* (2013.01); *F25D 2317/067* (2013.01); *F25D 2317/068* (2013.01); *F25D 2317/0682* (2013.01); *F25D 2321/00* (2013.01)

(58) Field of Classification Search
CPC ..... F25D 17/062; F25D 23/065; F25D 11/02; F25D 17/065; F25D 2201/10; F25D 2317/063; F25D 2317/068; F25D 2317/0682; F25D 2321/00
See application file for complete search history.

(56) References Cited

U.S. PATENT DOCUMENTS 10,969,157 B2 4/2021 Cheng et al.
2021/0172670 A1* 6/2021 Lee ..... F25D 23/02

FOREIGN PATENT DOCUMENTS

CN 1435644 A 8/2003
JP 2000329455 A 11/2000
KR 20120001864 A * 1/2012 ..... F25D 17/067
WO 2019001499 A1 1/2019

OTHER PUBLICATIONS

English language translation of KR20120001864 to Chang. Translated Sep. 2025 (Year: 2012).*

* cited by examiner

*Primary Examiner* — Cassey D Bauer
(74) *Attorney, Agent, or Firm* — Laurence A. Greenberg; Werner H. Stemer; Ralph E. Locher

(57) ABSTRACT

A cooling device includes a cabinet, a cooling system with cooling components, an inner casing having walls delimiting a storage chamber for storing foodstuffs, an inner back wall forming a rear part of the inner casing, an outer casing surrounding the inner casing, and an outer back wall forming a rear part of the outer casing. The cooling device further includes a back cover disposed between the inner back wall and the outer back wall for covering and housing at least one cooling component.

16 Claims, 15 Drawing Sheets

COOLING DEVICE HAVING A BACK COVER

CROSS-REFERENCE TO RELATED APPLICATION

This application claims the priority, under 35 U.S.C. § 119, of Turkish Patent Applications TR 2023/002472, filed Mar. 6, 2023, and TR 2023/002470, filed Mar. 6, 2023; the prior applications are herewith incorporated by reference in their entirety.

FIELD AND BACKGROUND OF THE INVENTION

The present invention relates to a cooling device including a cabinet, a cooling system with cooling components, an inner casing having walls delimiting a storage chamber for storing foodstuffs, an inner back wall forming the rear part of the inner casing, an outer casing surrounding the inner casing, and an outer back wall forming the rear part of the outer casing.

Refrigeration cycles are commonly used systems to control the temperature and humidity of air in various environments to be conditioned. In a typical refrigeration cycle of a cooling device, a refrigerant is compressed in a compressor and delivered to a condenser.

In order to keep foods fresh for a long time, the internal temperature of a freezing chamber and a cooling chamber of the cooling device must be kept uniform. For that purpose, cooling air outlet openings are mostly used, which are formed on corresponding walls of the cooling chamber, from which cooling air is introduced. However, it is difficult to robustly construct air return ducts for cooling air outlet openings, especially in cooling devices where multiple compartments share a common cooling unit.

A state-of-the-art International Publication WO 2019001499 A1, corresponding to U.S. Pat. No. 10,969,157 B2, discloses a refrigerator body, an air duct assembly, and a branched air supply apparatus. The branched air supply apparatus is installed in an accommodating cavity and is provided with a peripheral wall portion. The peripheral wall portion is provided thereon with a plurality of air outlets.

SUMMARY OF THE INVENTION

It is accordingly an object of the invention to provide a cooling device having a back cover, which overcomes the hereinafore-mentioned disadvantages of the heretofore-known devices of this general type and which provides more efficient air circulation while increasing the volume of the storage chamber.

With the foregoing and other objects in view there is provided, in accordance with the invention, a cooling device comprising a cabinet, a cooling system with cooling components, an inner casing having walls delimiting a storage chamber for storing foodstuffs, an inner back wall forming a rear part of the inner casing, an outer casing surrounding the inner casing, and an outer back wall forming a rear part of the outer casing. The cooling device further includes a back cover disposed between the inner back wall and the outer back wall for covering and housing at least one cooling component. Thus, enhanced freshness with minimal volume occupancy from the usable volume is provided.

In a possible embodiment, one of the cooling components is a fan unit having a fan and at least one fan unit is attached to the inner back wall. Thus, it is ensured that the fan unit works efficiently without occupying much space in the storage inner casing.

In a possible embodiment, the back cover has at least one fan housing for housing at least one fan unit. Thus, while the fan unit is working effectively, it is prevented from occupying space in the storage chamber.

In a possible embodiment, the fan housing has at least one first air channel which opens to a first air outlet, and at least one second air channel which opens to a second air outlet. Thus, it is ensured that the air inside the back cover is directed to different positions.

In a possible embodiment, the back cover has an inner housing for receiving an insulation member and allowing air to be returned. Thus, besides the efficient use of the returning air, possible icing is prevented.

In a possible embodiment, the inner housing has a plurality of spaced-apart guiding ribs extending along a longitudinal axis of the inner housing. Thus, it is ensured that the air in the back cover is effectively directed inside the inner housing.

In a possible embodiment, the insulation member is disposed to fit within the inner housing. Thus, an insulating member is used to prevent excessive cooling of the back cover, preventing situations that will cause blockages by accumulating ice on the surfaces.

In a possible embodiment, the inner housing has an air outlet portion formed at one end of the inner housing and at least one air inlet portion formed at the other end of the inner housing. Thus, the entry and exit points of the air to the back cover are determined and the most appropriate direction is made within the back cover.

In a possible embodiment, the inner back wall has at least one back wall air opening which is disposed with respect to the air inlet portion of the back cover. Thus, air enters the back cover through a suitable opening on the inner back wall.

In a possible embodiment, the inner housing has a middle portion in which the cross-section of the inner housing gradually decreases. Thus, the airflow passing through the inner housing is accelerated by narrowing the middle portion.

In a possible embodiment, the back cover has a plurality of interconnected supporting ribs formed on a wall of the back cover facing the outer back wall of the outer casing. Thus, the resistance of the back cover against bending and torsion is increased.

In a possible embodiment, the back cover has a plurality of connection members that can engage attachment holes provided on the inner back wall. Thus, it is ensured that the back cover is securely attached to the inner back wall without using any additional members.

In a possible embodiment, the fan unit has at least one air vent extending into the storage chamber for directing the circulating air by the fan into drawer(s) placed within the storage chamber. Thus, the air from the fan is effectively directed directly to the drawers.

In a possible embodiment, the back cover is made of a plastic material. Thus, a less costly and easily formable back cover is obtained.

In this context, the indications "top," "bottom," "front," "rear," "horizontal," "vertical," "upward," "downward," "inner," "outer," "inward," "outward," etc. refer to the positions and orientations given for intended use and intended arrangement of the cooling device and for a user then standing in front of the cooling device which is in a closed position and viewing in the direction of the device.

Each possible embodiment disclosed in this text can be combined with the other possible embodiments disclosed in this text if there is not any technical constraint.

Other features which are considered as characteristic for the invention are set forth in the appended claims.

Although the invention is illustrated and described herein as embodied in a cooling device having a back cover, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
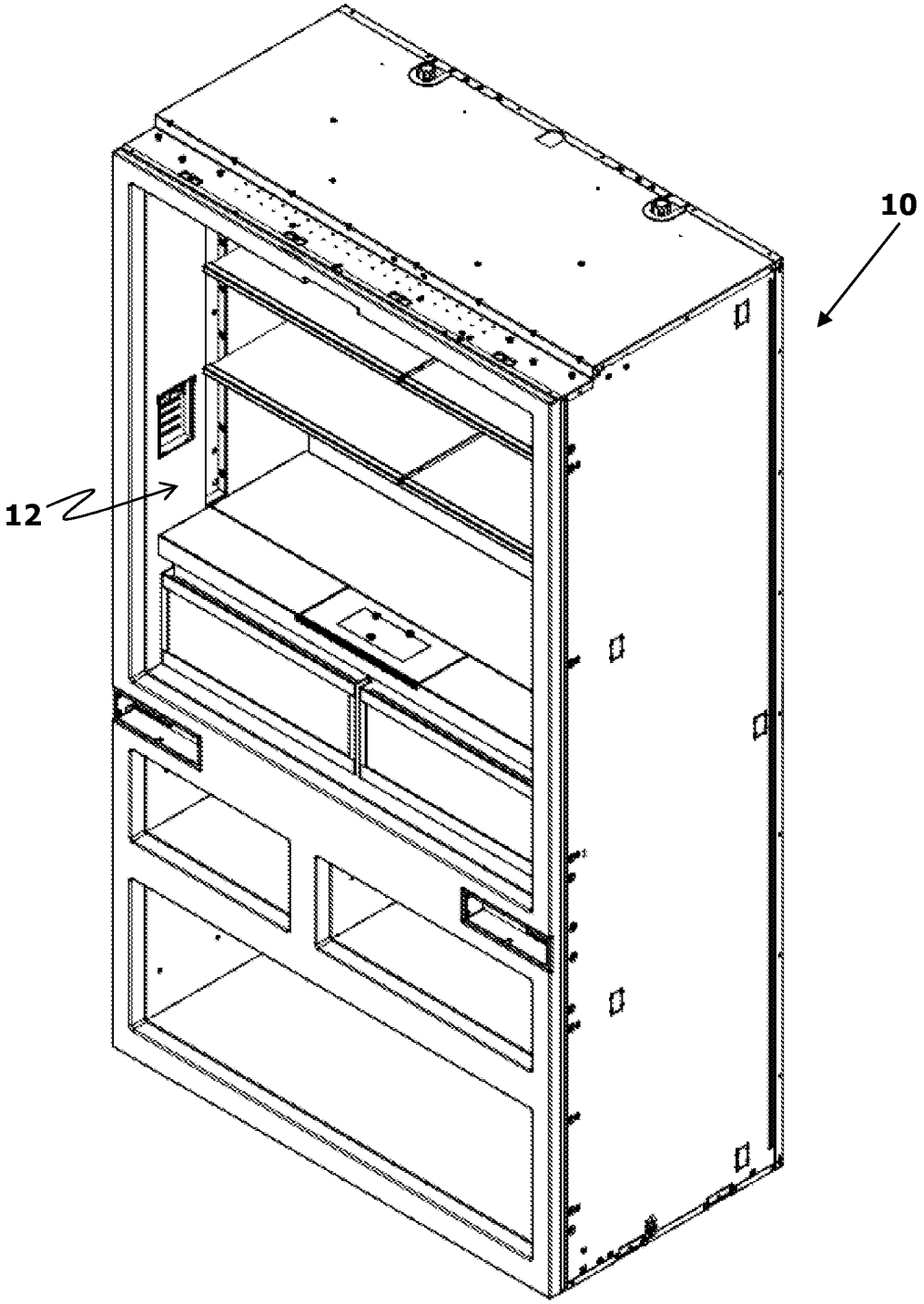
FIG. 1 is a diagrammatic, perspective view of a cabinet of a cooling device, according to the present invention.

Referring now to the figures of the drawings as a whole, the following is a detailed explanation in which the subject matter of the invention is explained with examples in order to make the subject more understandable without forming any restrictive effect. According to this, in the detailed explanation below, a back cover 60 is explained to be applied to a cooling device 100 such as a refrigerator.

The present invention proposes a cooling device 100 including a cabinet 10, a cooling system with cooling components, an inner casing 11 having walls delimiting a storage chamber 12 for storing foodstuffs or groceries, an inner back wall 30 forming the rear part of the inner casing 11, an outer casing 13 surrounding the inner casing 11, and an outer back wall 20 forming the rear part of the outer casing 13.

Figure 7:
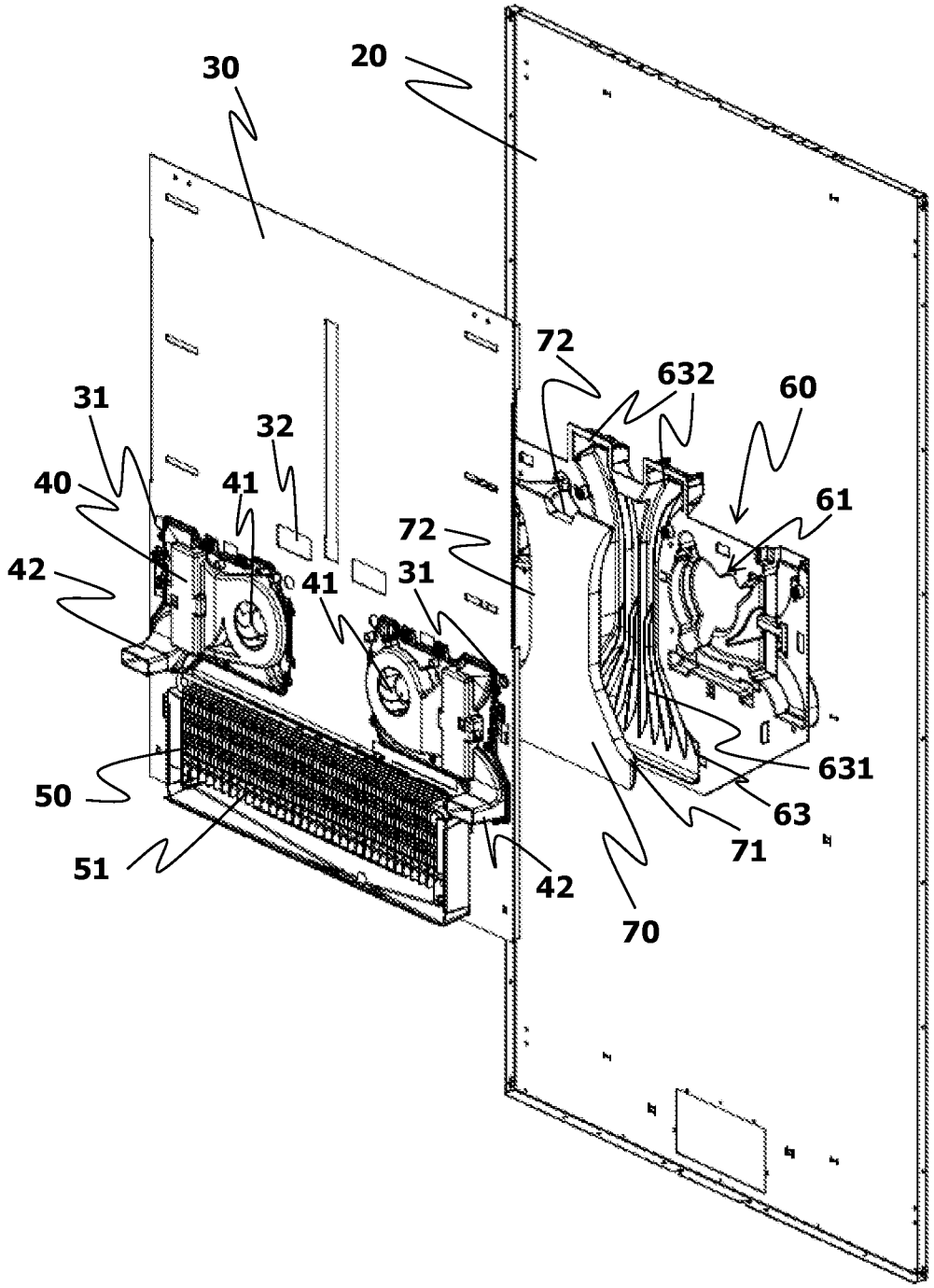
FIG. 7 is a perspective view of the inner and outer back walls between which a back cover is provided, according to the present invention.

Referring to FIG. 7, the cooling device 100 further includes the back cover 60 which is disposed between the inner back wall 30 and the outer back wall 20 for covering and housing at least one cooling component. This back cover 60 is attached to the inner back wall 30. The inner side of the back cover 60 can be shaped according to one of the cooling components of the cooling device 100. One of the cooling components can be a fan unit 40 having a fan 41 for circulating the air within the cooling device 100. As can be seen in FIG. 7, two identically shaped fan units 40 are provided in the inner back wall 30 which partly extends with respect to the outer back wall 20. The back cover 60 is disposed with respect to these fan units 40 and covers the extended part of the fan unit 40 and has corresponding portions with respect to the fan unit 40. The fan unit 40 has a series of air channels specifically for conveying the air coming from the fan 41. Therefore, there are opposing channels on the back cover 60 to match these air channels.

Figure 8:
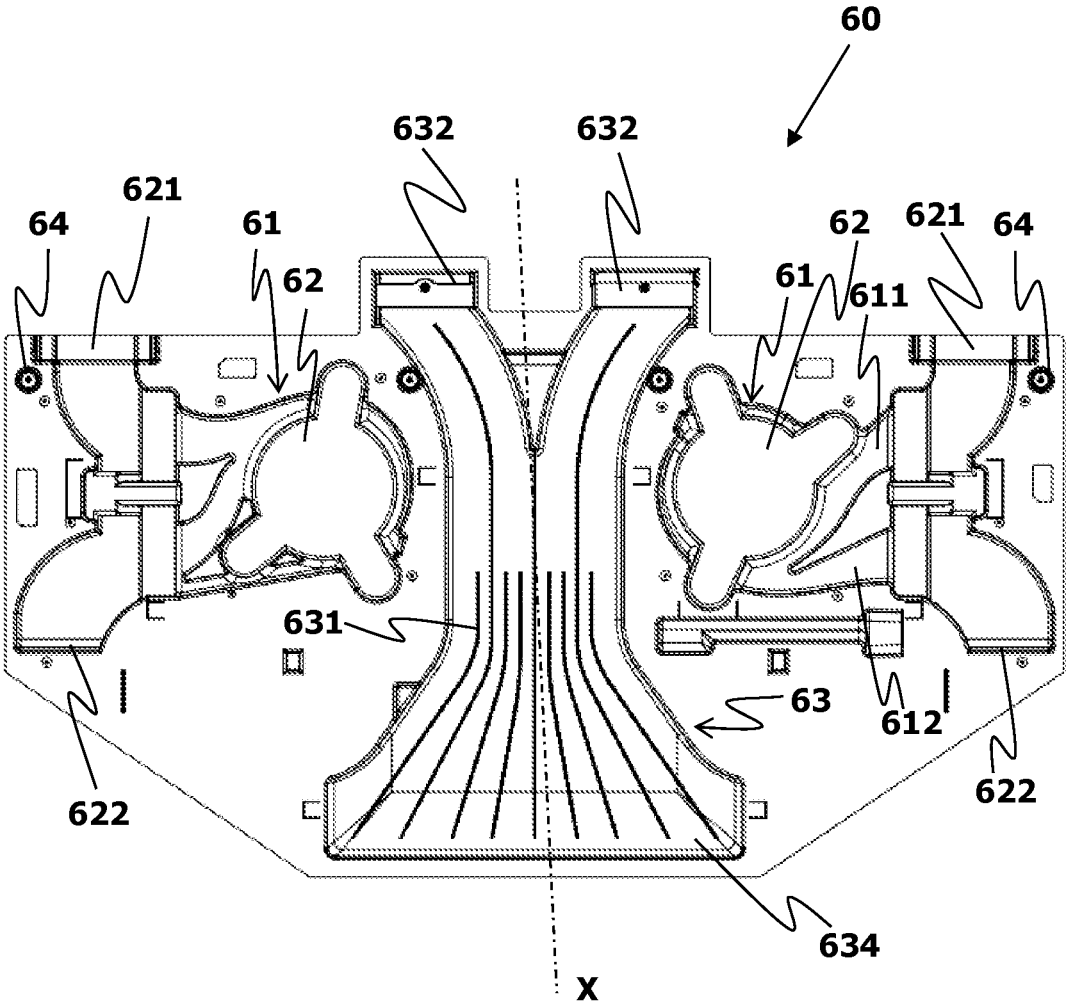
FIG. 8 is a front-elevational view of the back cover of the cooling device according to the present invention.
Figure 9:
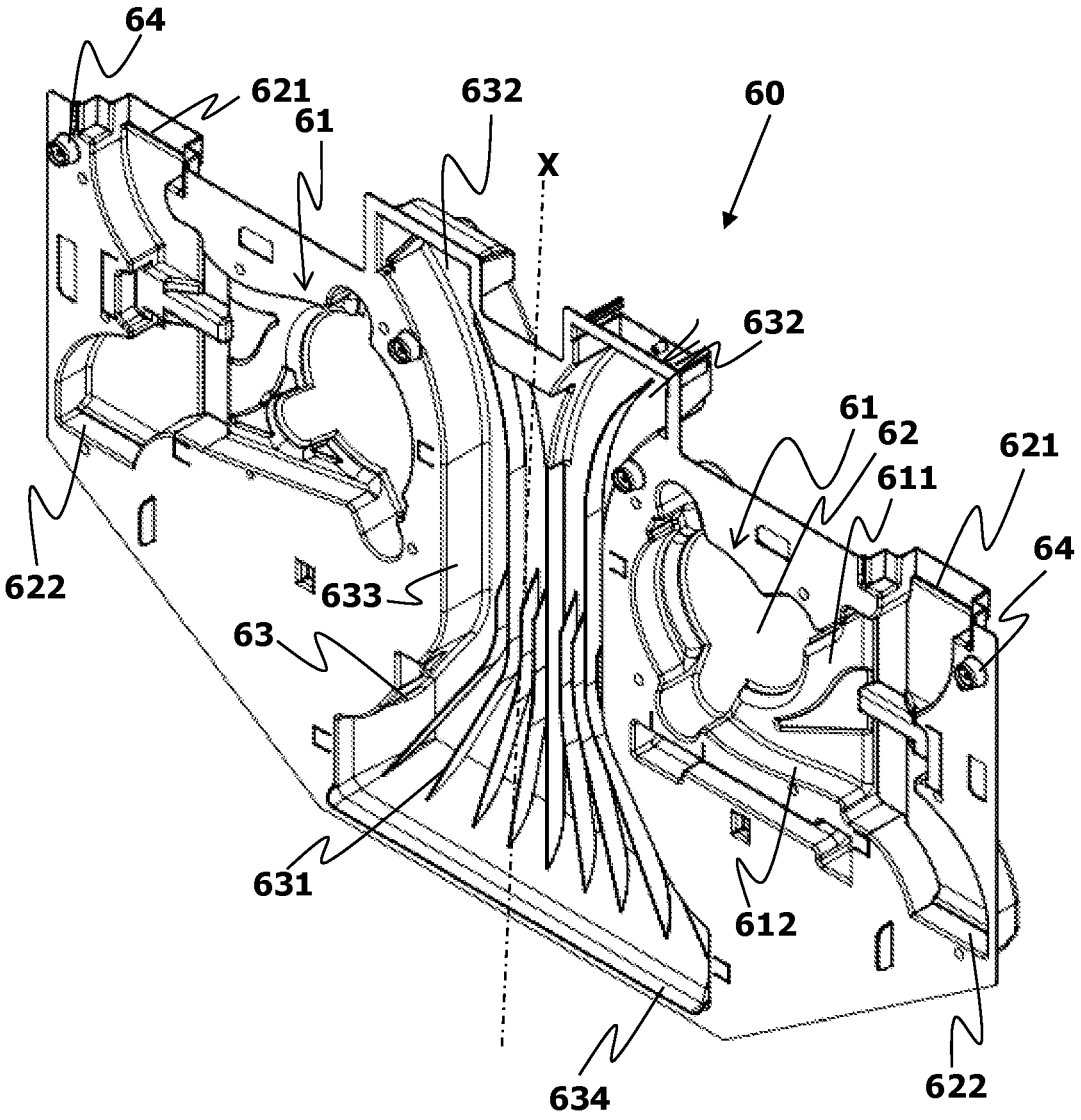
FIG. 9 is a perspective view of the back cover of the cooling device according to the present invention.
Figure 10:
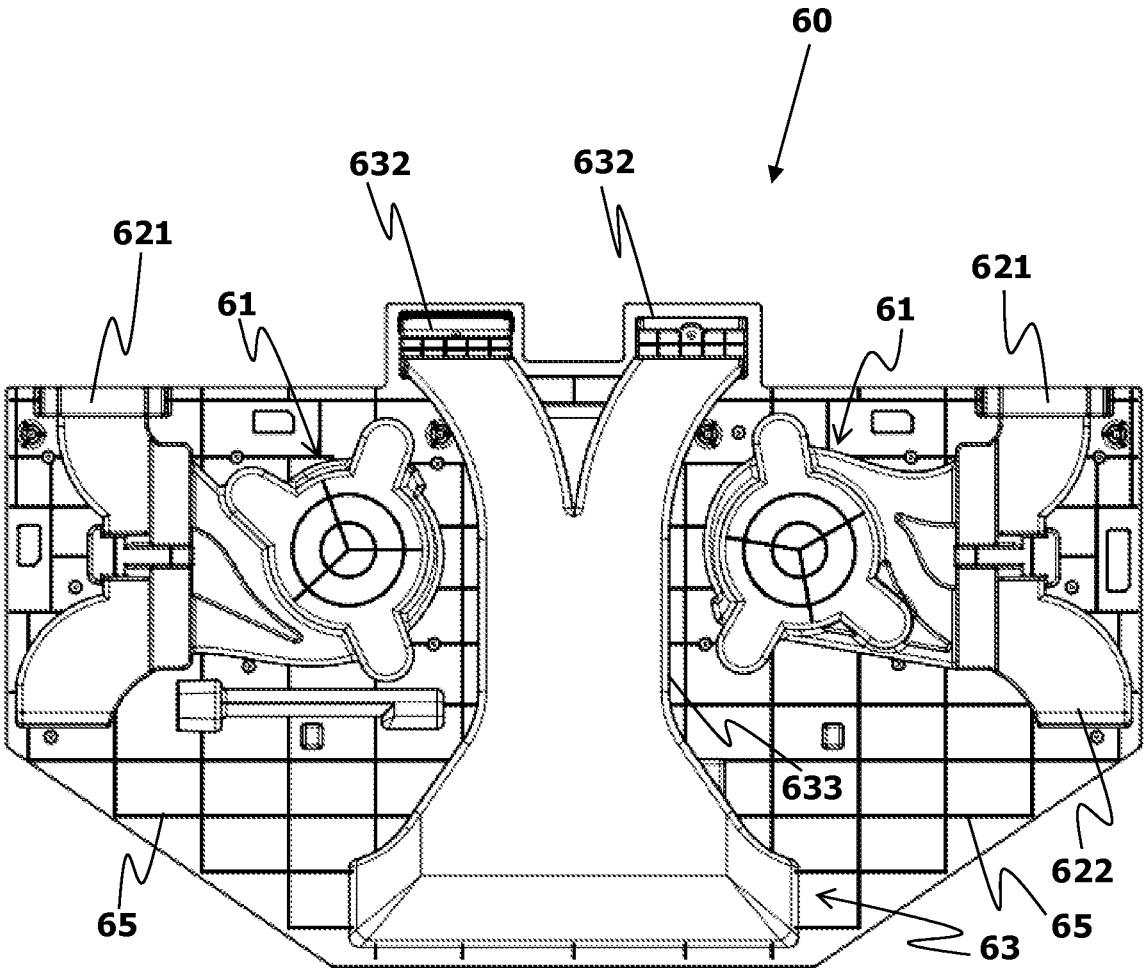
FIG. 10 is a rear-elevational view of the back cover of the cooling device according to the present invention.
Figure 12:
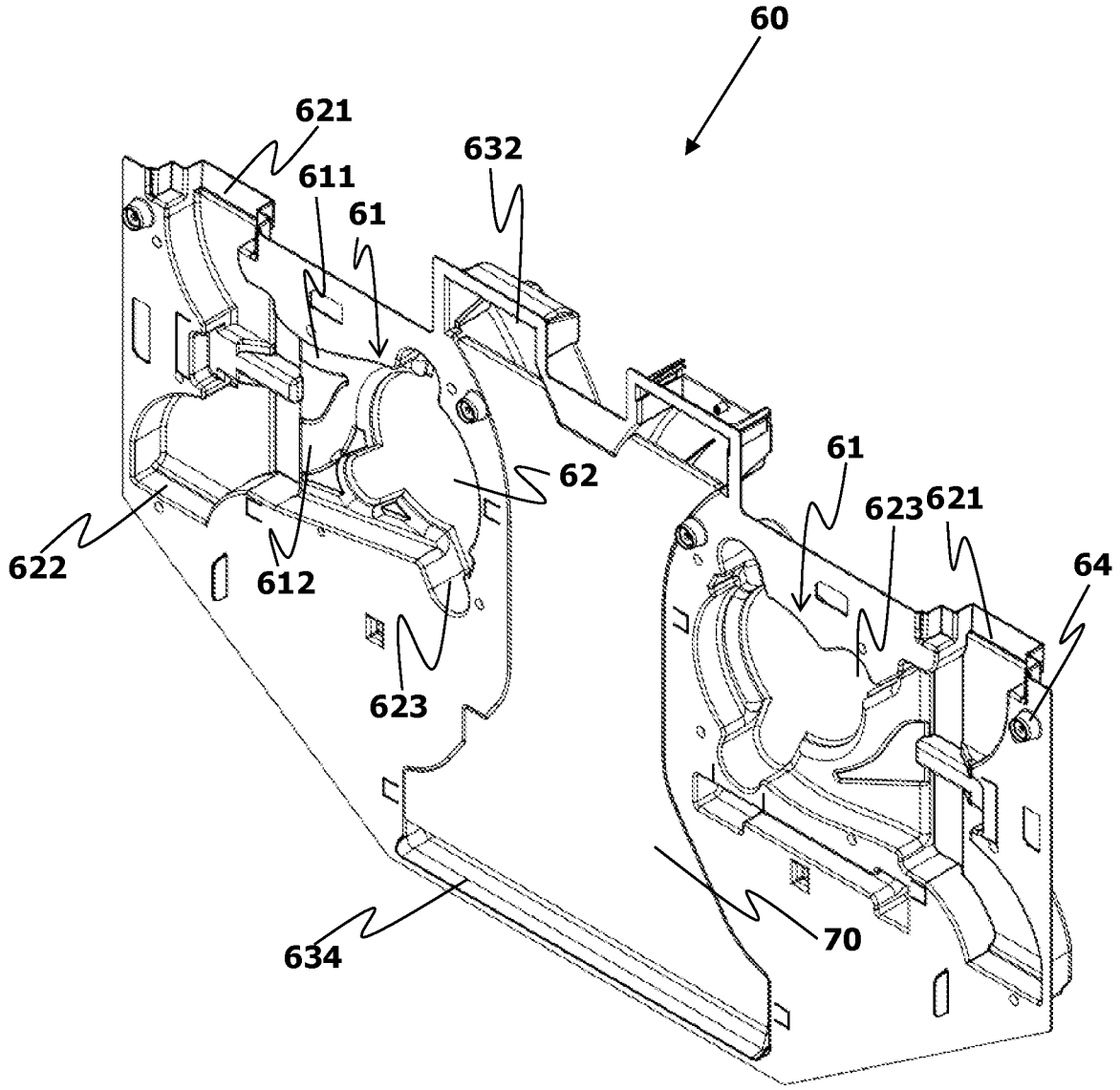
FIG. 12 is a perspective view of the back cover having an attached insulation member, according to the present as shown in FIG. 10.

The back cover 60 has at least one fan housing 61 for housing at least one fan unit 40. Referring to FIGS. 8 and 9, the back cover 60 has two fan housings 61 for housing the corresponding fan units 40. Referring to FIGS. 10 and 12, the fan housing 61 has at least one first air channel 611 which extends to a first air outlet 621, and at least one second air channel 612 which extends to a second air outlet 622. The fan housing 61 has a fan hole 62 with at least one attachment groove 623 for receiving the fan 41 properly. Referring to FIG. 10, an inner wall of the back cover 60 has two fan housings 61, and an inner housing 63 for receiving an insulation member 70 is formed between the fan housings 61. The first air channel 611 extends from the fan hole 62 with a variable cross-section to the first air outlet 621 formed at an upper portion of the back cover 60. Accordingly, the second air channel 612 also extends from the fan hole 62 with a variable cross-section to the second air outlet 622 which is opposite to the first air outlet 621. The first air outlet 621 can then be connected with a ventilation extension and the air can be transferred to certain points on the inner back wall 30.

Referring to FIG. 7, the fan unit 40 has at least one air vent 42 extending into the storage chamber 12 for directing the circulating air by the fan 41 into drawer(s) placed within the storage chamber 12. These air vents 42 correspond to the second air outlet 622 of the back cover 60 and direct the air coming from the fan 41.

Figure 11:
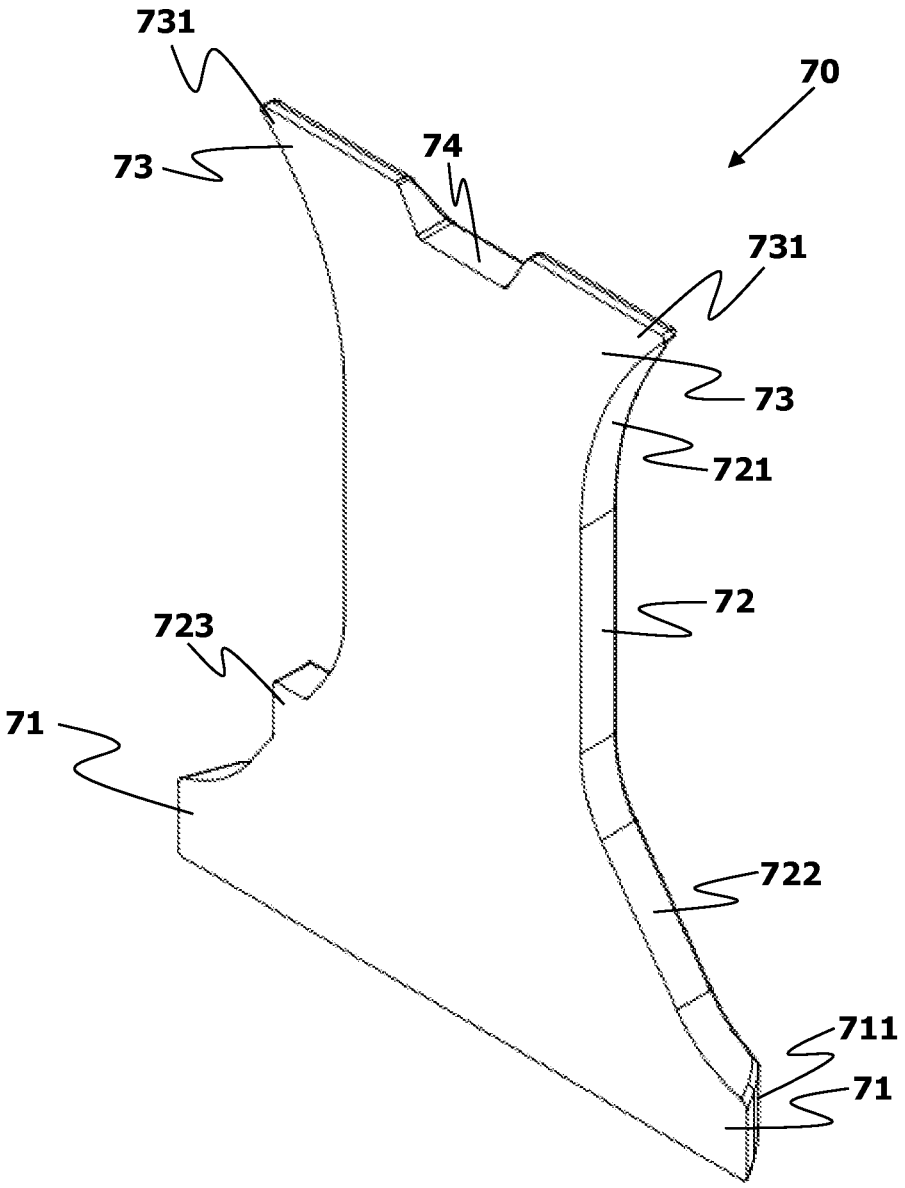
FIG. 11 is a perspective view of an insulation member according to the present invention.

According to FIG. 9, the inner housing 63 of the back cover 60 has a plurality of spaced apart guiding ribs 631 extending partly along a longitudinal axis X of the inner housing 63. These guiding ribs 631 initially lie inclined relative to the longitudinal axis X of the inner housing 63, and then vertically extend in the middle portion thereof. Referring to FIGS. 10 and 11, the insulation member 70 is disposed to fit on the inner housing 63 and is disposed to supply insulation between a cold evaporator 51 and warm and humid return air.

Figure 6:
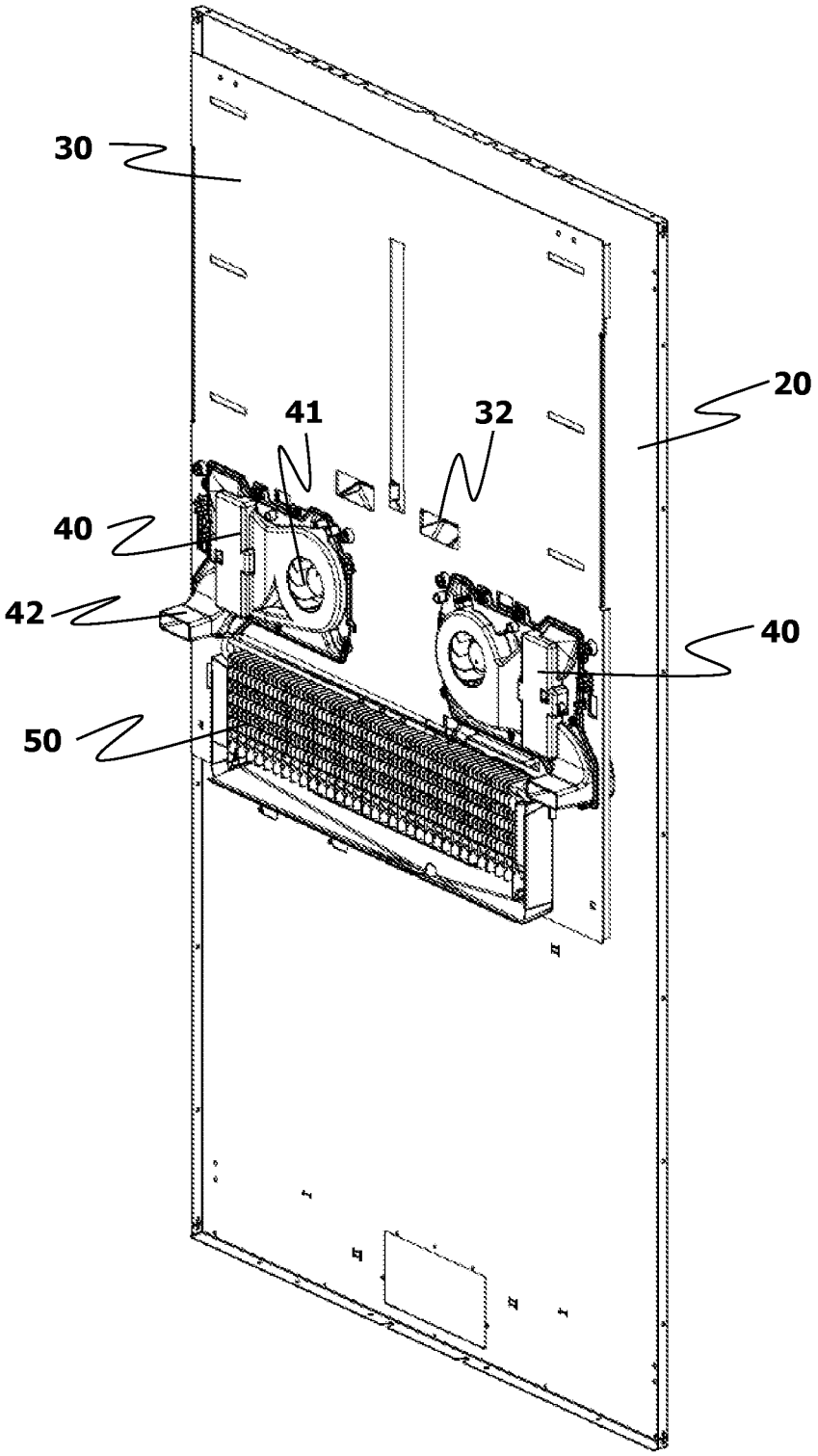
FIG. 6 is a perspective view of the inner and outer back walls shown in FIG. 4.

Referring to FIGS. 10 and 12, the inner housing 63 has an air outlet portion 634 formed at one end i.e., at the bottom of the inner housing 63 and at least one air inlet portion 632 formed at the other end i.e., at the top of the inner housing 63. Accordingly, the inner back wall 30 has at least one back wall air opening 32 which is disposed with respect to the air inlet portion 632 of the back cover 60. Referring to FIG. 6, the inner back wall 30 has two back wall air openings 32 aligned with respect to the back wall air openings 32.

Referring to FIG. 9, the inner housing 63 has a middle portion 633 in which the cross-section of the inner housing 63 gradually decreases and then increases. The inner housing 63 is formed as an air duct in the middle portion of the back cover 60. The lower part of the inner housing 63 extends inwards in a sloping manner and narrows in cross-section towards the middle portion. The inner housing 63 then expands towards the top portion of the back cover 60 and splits into two separate branches, which extend into the air inlet portions 632. Since there are several cavities, channels, and protrusions on the back cover 60, it is produced from a plastic material in a way that it can be formed more easily.

Referring to FIGS. 10 and 11, the insulation member 70 has an engagement protrusion 723 for engaging a corresponding groove 66 on the back cover assembly 60. Preferably, the engagement protrusion 723 is formed as a protrusion on the lateral side of the insulation member 70 and has a trianglualr cross-section.

The insulation member 70, preferably, has two first corner ends 71 with an inwardly inclined chamfered edge 711 for placing the insulation member 70 on the back cover assembly 60. Referring to FIG. 11, two first corner ends 71 are formed at the two opposite corners of the insulation member 70. Moreover, the insulation member 70 has two second corner ends 73, between which an inner groove 74 is formed. The two second corner ends 73 are formed at the opposite side with respect to the first corner ends 71 of the insulation member 70. Referring to FIG. 11, the second corner ends 73 have a substantially flat wall and a tapering tip portion 731.

The insulation member 70 has an intermediate portion 72 in which the cross-section of the insulation member 70 gradually decreases inward. Accordingly, the inner housing 63 has the middle portion 633 in which the cross-section of the inner housing 63 gradually decreases and then increases. Referring to FIG. 11, the insulation member 70 has first concave portions 721 extending concavely from the lateral sides of the intermediate portion 72 to the tip portion 731 of the second corner end. Similarly, the insulation member 70 also has second concave portions 722 extending concavely from the lateral sides of the intermediate portion 72 to the first corner ends 71 of the insulation member 70. The inner housing 63 is formed as an air duct in the middle portion of the back cover assembly 60.

Figure 2:
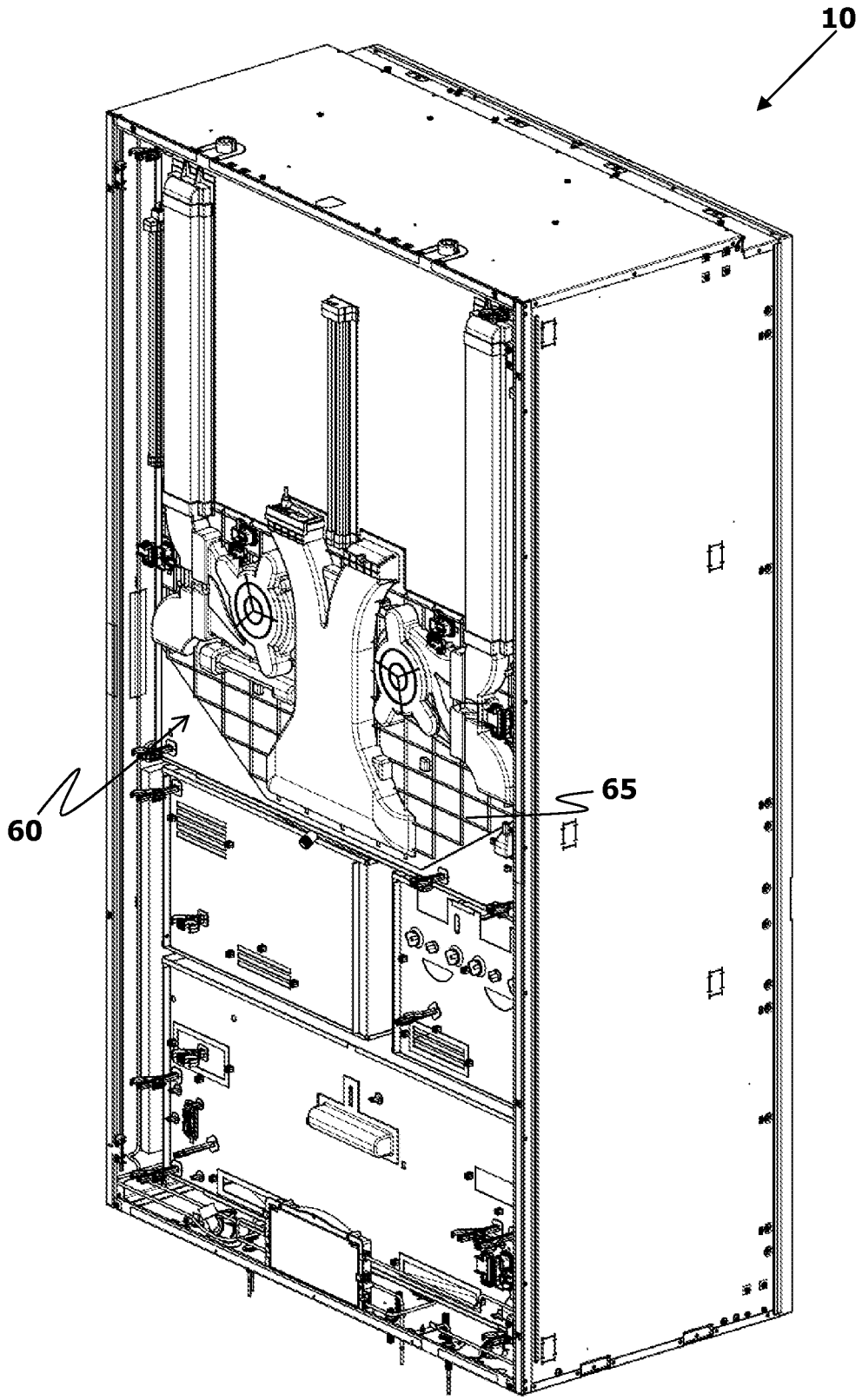
FIG. 2 is a rear perspective view of the cabinet shown in FIG. 1.
Figure 3:
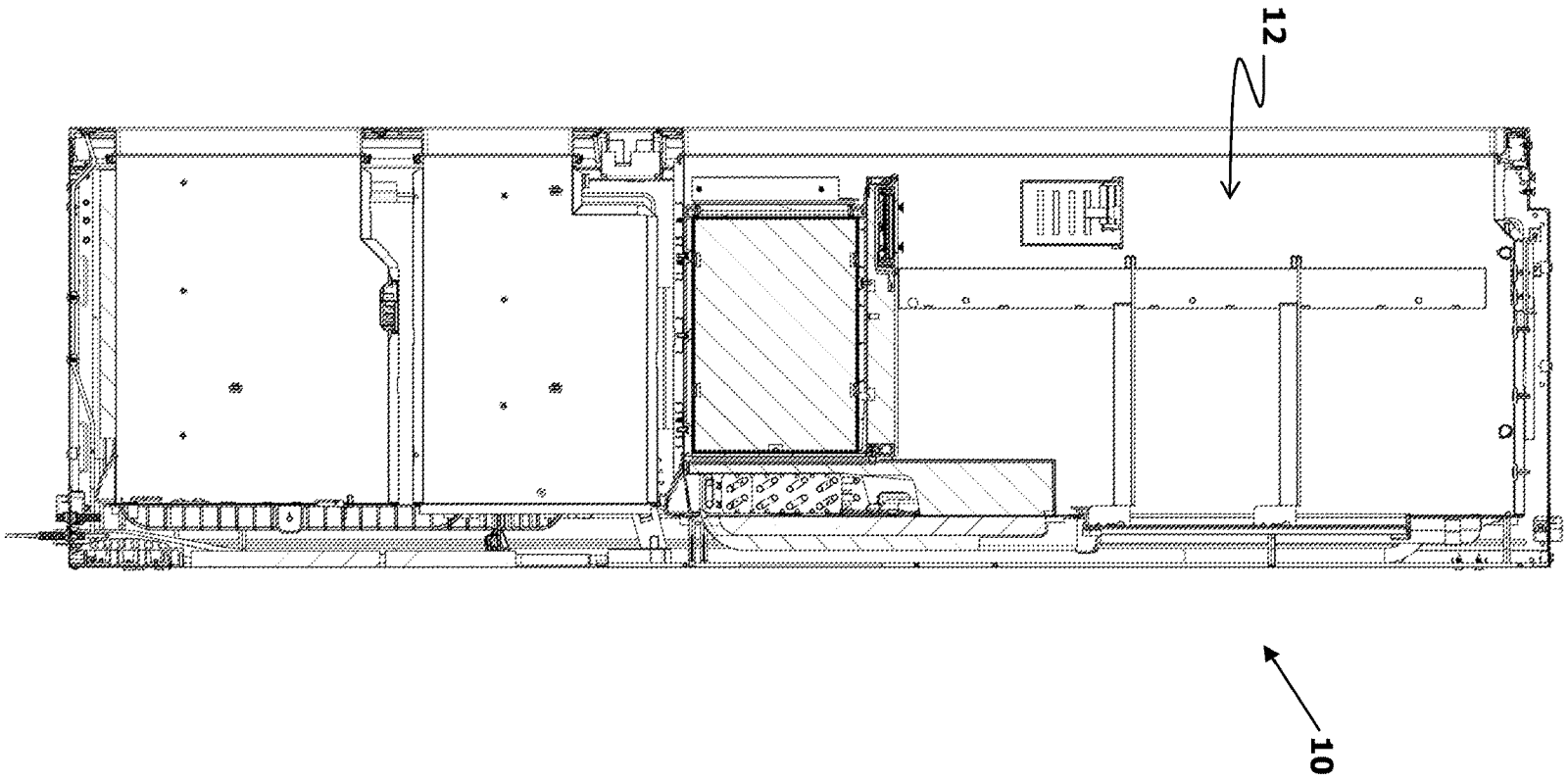
FIG. 3 is a lateral cross-sectional view of the cabinet shown in FIG. 1.

Referring to FIG. 2, the back cover 60 has a plurality of interconnected supporting ribs 65 formed on a wall of the back cover 60 facing the outer back wall 20 of the outer casing 13, when in use. The supporting ribs 65 are mostly formed in the form of protrusions in connection with each other to form a square or more rectangular section. In a possible embodiment, the number of supporting ribs can vary.

The back cover 60 has a plurality of connection members 64 that can engage attachment holes 31 provided on the inner back wall 30. Referring to FIG. 8, the connection members 64 formed in the form of fasteners are located at different locations on the back cover 60. When attaching the back cover 60 to the inner back wall 30, firstly the insulation member 70 is fitted within the inner housing 63 and then the back cover 60 aligns with the corresponding attachment holes 31 formed on the inner back wall 30 and is then pressed against it. Thus, a solid connection is obtained.

Figure 4:
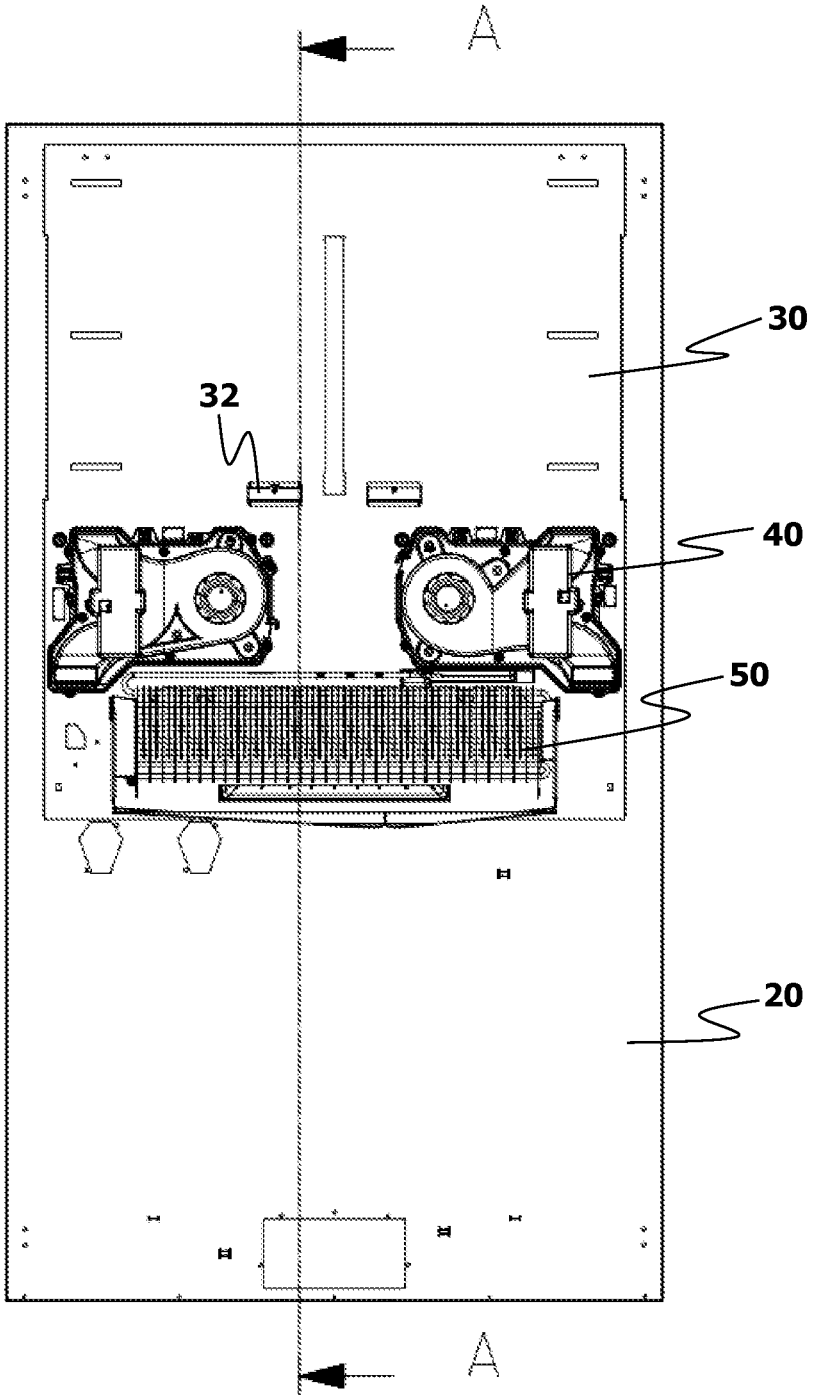
FIG. 4 is a front-elevational view of inner and outer back walls with attached fan and evaporator units for the cooling device, according to the present invention.
Figure 5:
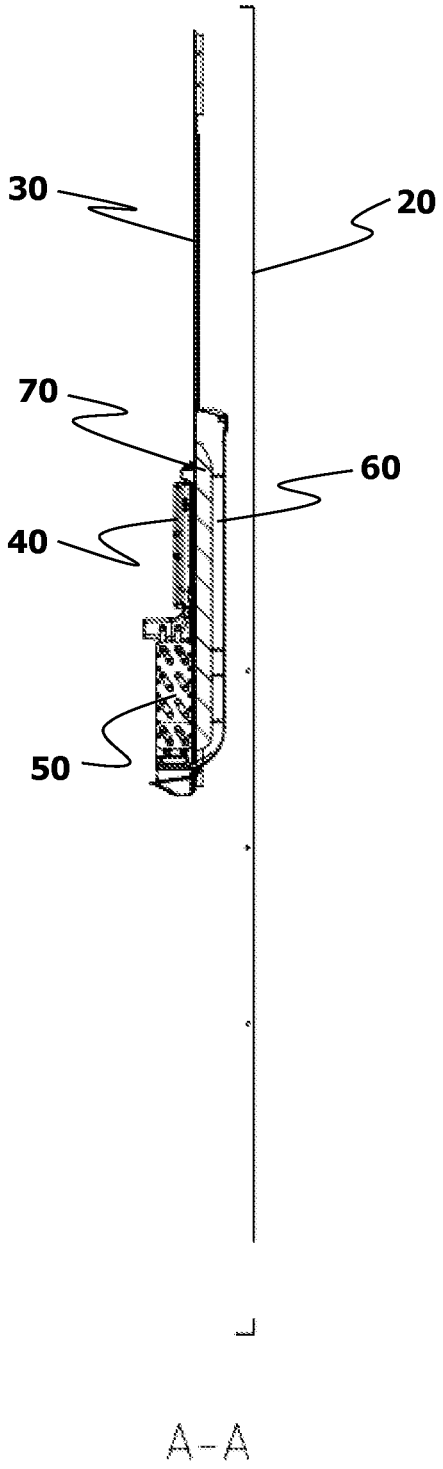
FIG. 5 is a cross-sectional view taken along a line A-A shown in FIG. 4, in the direction of the arrows.

Referring to FIG. 1, the cabinet 10 of the cooling device 100 has the inner casing 11 for forming the storage chamber 12, and the outer casing 13 covering the inner casing 11. An insulation material i.e., polyurethane is foamed between the inner casing 11 and the outer casing 13. Referring to FIGS. 4, 5 and 7, an evaporator unit 50 has a vertically extending evaporator 51 adjacent to the inner back wall 30, and two fan units 40 are placed just above the evaporator unit 50.

Figure 13:
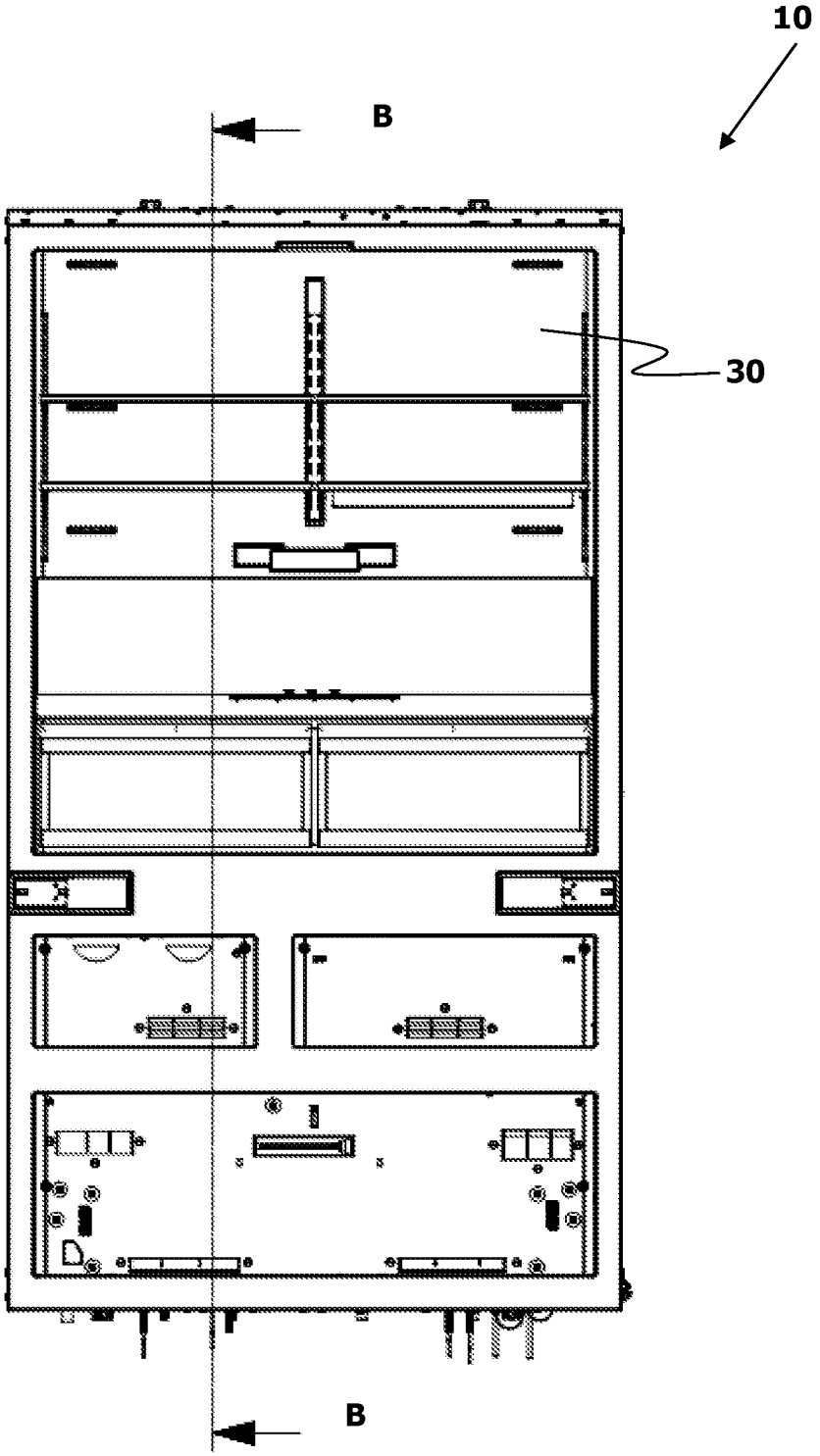
FIG. 13 is a front-elevational view of the cabinet of the cooling device according to the present invention.
Figure 14:
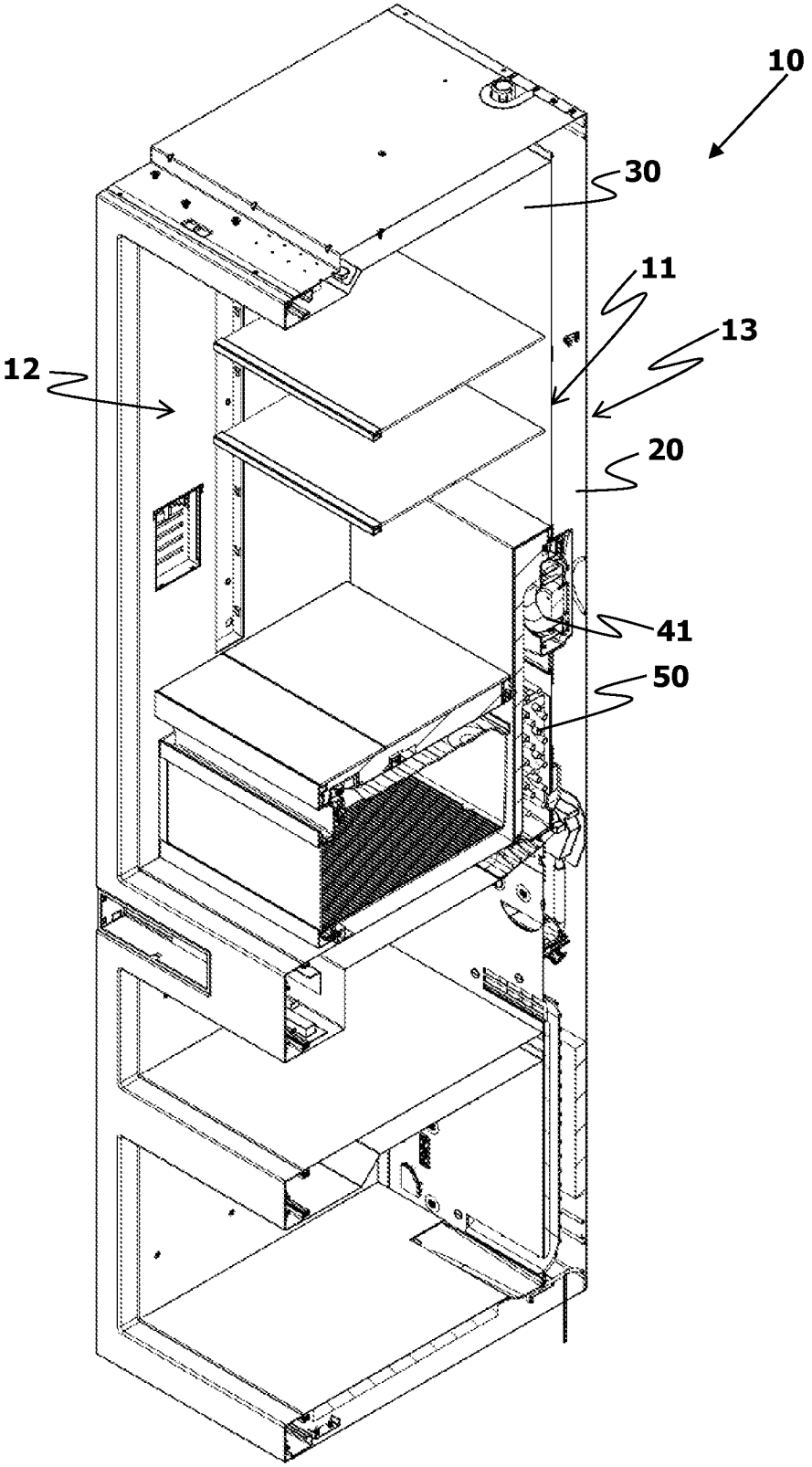
FIG. 14 is a cross-sectional view taken along a line B-B shown in FIG. 13, in the direction of the arrows.
Figure 15:
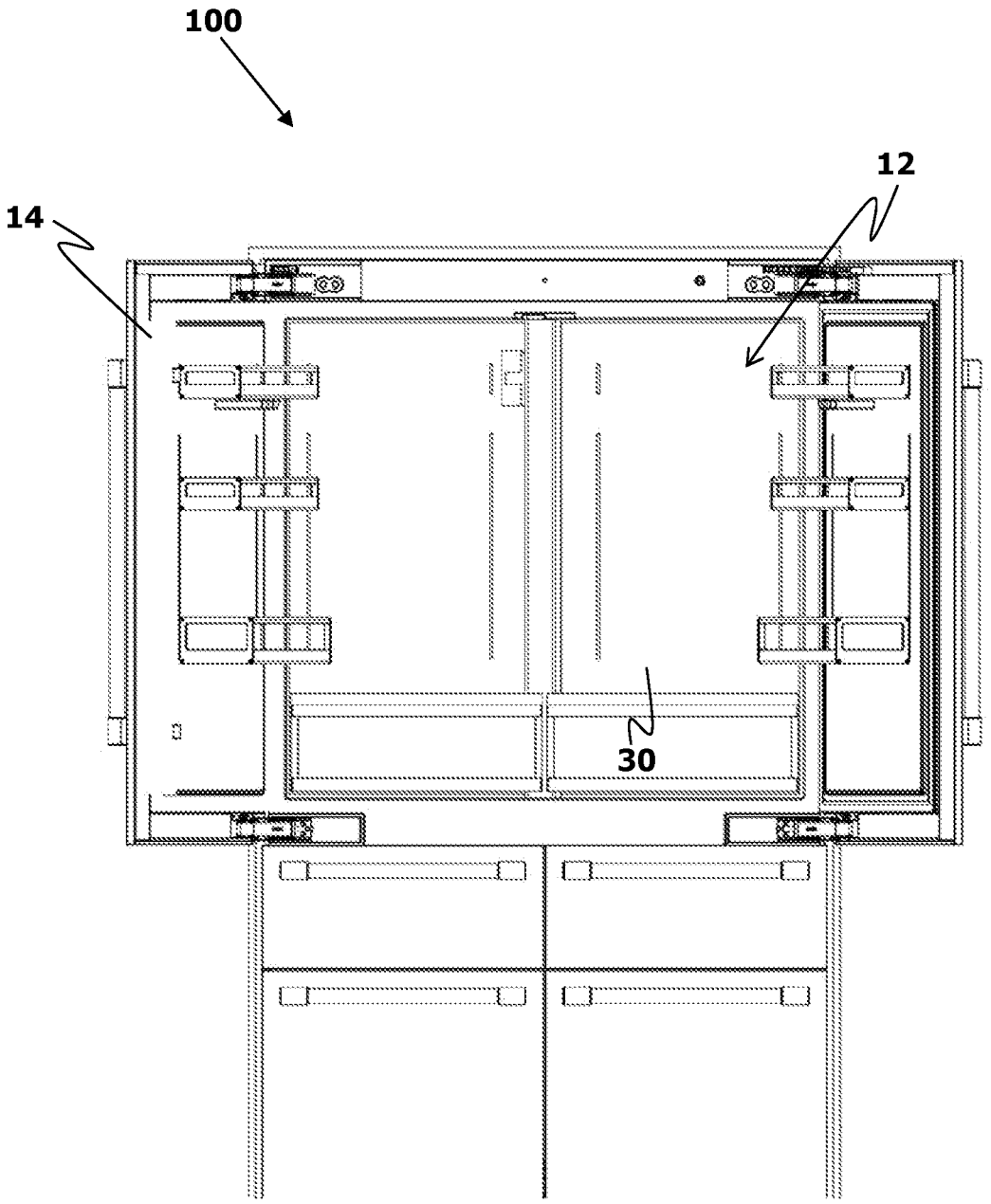
FIG. 15 is a front-elevational view of the cooling device where doors of the cooling device are open, according to the present invention.

Referring to FIGS. 13, 14 and 15, the cooling device 100 includes the cabinet 10 and at least one storage compartment 12 surrounded by the cabinet 10. These storage compartments 12 can be a freezer compartment provided at the upper side of the cooling device 100 and a refrigerating compartment provided at the lower side of the cooling device 100. Doors 14 are provided for selectively closing the storage compartment 11.

The following is a summary list of reference numerals and the corresponding structure used in the above description of the invention:

10 Cabinet
11 Inner casing
12 Storage chamber
13 Outer casing
14 Door
20 Outer back wall
30 Inner back wall
31 Attachment hole
32 Back wall air opening
40 Fan unit
41 Fan
42 Air vent
50 Evaporator unit
51 Evaporator
60 Back cover
61 Fan housing
611 First air channel
612 Second air channel
62 Fan hole
621 First air outlet
622 Second air outlet
623 Attachment groove
63 Inner housing
631 Guiding rib
632. Air inlet portion
633 Middle portion
634 Air outlet portion
70 Insulation member
71 First corner end
711 Chamfered edge
72 Intermediate portion
72 First concave portion
722 Second concave portion
723 Engagement protrusion
73 Second corner end
73 Tip portion
74 Inner groove
100 Cooling device
X Longitudinal axis of the inner housing

The invention claimed is:

1. A cooling device, comprising:
a cabinet;
a cooler with cooling components;
an inner casing having walls delimiting a storage chamber for storing foodstuffs;
an inner back wall forming a rear part of said inner casing;
an outer casing surrounding said inner casing;
an outer back wall forming a rear part of said outer casing;

a back cover disposed between said inner back wall and said outer back wall for covering and housing at least one of said cooling components; and an insulation member;

said back cover having an inner housing for receiving said insulation member and allowing air to be returned.

2. The cooling device according to claim 1, wherein one of said cooling components is at least one fan unit having a fan, and said at least one fan unit is attached to said inner back wall.

3. The cooling device according to claim 2, wherein said back cover has at least one fan housing for housing said at least one fan unit.

4. The cooling device according to claim 3, wherein said fan housing has at least one first air channel extending to a first air outlet and at least one second air channel extending to a second air outlet.

5. The cooling device according to claim 1, wherein said inner housing has a plurality of spaced apart guiding ribs extending along a longitudinal axis of said inner housing.

6. The cooling device according to claim 5, wherein said insulation member is disposed to fit within said inner housing.

7. The cooling device according to claim 1, wherein said inner housing has an air outlet portion formed at one end of said inner housing and at least one air inlet portion formed at another end of said inner housing.

8. The cooling device according to claim 7, wherein said inner back wall has at least one back wall air opening aligned with said air inlet portion of said back cover.

9. The cooling device according to claim 1, wherein said inner housing has a middle portion at which a cross-section of said inner housing gradually decreases.

10. The cooling device according to claim 1, wherein said back cover has a plurality of interconnected supporting ribs formed on a wall of said back cover facing said outer back wall of said outer casing.

11. The cooling device according to claim 1, wherein said back cover has a plurality of connections configured to engage attachment holes provided in said inner back wall.

12. The cooling device according to claim 2, wherein said at least one fan unit has at least one air vent extending into said storage chamber for directing air circulated by said fan into at least one drawer to be placed within said storage chamber.

13. The cooling device according to claim 6, wherein said insulation member has an engagement protrusion for engaging a corresponding groove formed in said back cover.

14. The cooling device according to claim 6, wherein said insulation member has first corner ends with an inwardly inclined chamfered edge for placing said insulation member on said back cover.

15. A cooling device, comprising:

a cabinet;

a cooler with cooling components;

an inner casing having walls delimiting a storage chamber for storing foodstuffs;

an inner back wall forming a rear part of said inner casing;

an outer casing surrounding said inner casing;

an outer back wall forming a rear part of said outer casing;

a back cover disposed between said inner back wall and said outer back wall for covering and housing at least one of said cooling components; and an insulation material disposed between said inner casing and said outer casing and abutting said back cover.

16. A cooling device, comprising:

a cabinet;

a cooler with cooling components including an evaporator unit;

an inner casing having walls delimiting a storage chamber for storing foodstuffs;

an inner back wall forming a rear part of said inner casing;

an outer casing surrounding said inner casing;

an outer back wall forming a rear part of said outer casing; and a back cover disposed between said inner back wall and said outer back wall for covering and housing at least one of said cooling components, said back cover being disposed between said evaporator unit and said outer back wall.

* * * * *